US007691209B2

(12) United States Patent
Reichold

(10) Patent No.: US 7,691,209 B2
(45) Date of Patent: Apr. 6, 2010

(54) AUTOMATIC CONTROL SYSTEM FOR A KITCHEN WAREWASHER

(75) Inventor: Kurt A. Reichold, Mukwonago, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 1094 days.

(21) Appl. No.: 11/203,916

(22) Filed: Aug. 15, 2005

(65) Prior Publication Data

US 2007/0034236 A1 Feb. 15, 2007

(51) Int. Cl.
*B08B 9/20* (2006.01)

(52) U.S. Cl. ..... 134/25.2; 134/56 D; 134/57 D; 134/58 D

(58) Field of Classification Search ..... None
See application file for complete search history.

(56) References Cited

U.S. PATENT DOCUMENTS

| | | | | |
|---|---|---|---|---|
| 3,087,504 A | | 4/1963 | Geschka | |
| 3,464,673 A | * | 9/1969 | Cargo et al. | 340/309.4 |
| 3,545,481 A | | 12/1970 | Fratalia | |
| 3,896,827 A | | 7/1975 | Robinson | |
| 5,259,889 A | | 11/1993 | Payzant | |
| 5,617,885 A | | 4/1997 | Centis | |
| 5,839,454 A | | 11/1998 | Matz | |
| 5,909,743 A | | 6/1999 | Thies et al. | |
| 6,103,017 A | | 8/2000 | Thies et al. | |
| 6,432,216 B1 | | 8/2002 | Thies | |
| 6,551,414 B2 | * | 4/2003 | Reichold | 134/18 |
| 2003/0127110 A1 | * | 7/2003 | Reichold et al. | 134/18 |
| 2004/0173245 A1 | | 9/2004 | Elick et al. | |
| 2004/0200512 A1 | | 10/2004 | Clouser et al. | |
| 2005/0257810 A1 | | 11/2005 | Bigott | |

FOREIGN PATENT DOCUMENTS

DE 199 06 791 A1 8/2000

* cited by examiner

*Primary Examiner*—Michael Kornakov
*Assistant Examiner*—Eric Golightly
(74) *Attorney, Agent, or Firm*—Quarles & Brady LLP; George E. Haas

(57) ABSTRACT

An apparatus reminds an operator of a need to change water in a reservoir of a warewasher. A counter that counts operating cycles of the warewasher and a sensor provides signal indicating that the reservoir has been drained and refilled. A controller responds to the counter having a first threshold value by activating an annunciator to alert the operator that is it time to change the water. Thereafter when the counter has a greater second threshold value and the controller disables operation of the warewasher until the sensor indicates that the reservoir has been drained and refilled. Thus the operator is required to change the water in order to continue using the warewasher.

7 Claims, 3 Drawing Sheets

AUTOMATIC CONTROL SYSTEM FOR A KITCHEN WAREWASHER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to automatic warewashers for kitchenware; and in particular to electronic control circuits for automatically operating the warewasher.

2. Description of the Related Art

Commercial kitchens have equipment to clean and sanitize glassware, dishes, silverware, pot, pans and cooking utensils, which are collectively referred to as "kitchenware." Such equipment, commonly known as a "dishwasher" or more generically as a "warewasher", has a cabinet defining an internal chamber into which trays of kitchenware are placed for washing. A washing and rinsing assembly within the chamber has a plurality of nozzles from which water sprays onto the kitchenware being cleansed. The lower part of the cabinet forms a reservoir that collects the water which is repeatedly circulated through the nozzles by a pump during the wash cycle. Then, fresh water from an external supply line is fed through the nozzles during a rinse cycle. When the rinse water flows into the reservoir, some of the reservoir water overflows into a drain thus replacing some of the water from the wash cycle.

Because the water is not completely drained from the reservoir for each wash cycle, food particles, grease and other debris from the kitchenware accumulates in the reservoir. As a result a human operator periodically (e.g. every two hours of operation) must manually drain and refill the warewasher to remove the accumulated debris and provide fresh water. Operators often forget to change the water or lose track of how long the time interval has been since the previous water change.

To solve this problem, various systems have been developed to remind the operator when to change the water. One such system, counted the number of wash cycles and upon the occurrence of a given number of cycles, provided a visual or audible warning to the operator indicating the need to change the wash water. For example, a lamp on a control panel illuminated and a buzzer sounded to provide that indication. However, operators often ignored this warning, pressed a reset switch and continued to wash dishes without changing the water in the warewasher. Failure to periodically drain and refill the machine with fresh water allows debris to accumulate to unsatisfactory levels which adversely affects proper cleaning of the kitchenware.

Therefore, there still exists a need for a control system that requires operators occasionally drain and refill the water in a warewashing machine.

SUMMARY OF THE INVENTION

A method for controlling operation of a warewasher detects a condition that requires corrective action. Examples of such conditions include the need to change the water in the warewasher, the water having too low a temperature for satisfactory cleaning, or exhaustion of detergent or another chemical in an automatic dispenser. Upon the occurrence of the condition the human operator is alerted of the need to take the corrective action. Thereafter, an operational parameter of the warewasher is monitored to provide an indication when the corrective action is taken. If the corrective action does not occur, subsequent operation of the warewasher is disabled. When the monitoring indicates occurrence of the corrective action, operation of the warewasher is enabled.

One version of this method is adapted to indicate when water in a reservoir of the warewasher needs to be drained and refilled. This process involves counting operations of the warewasher to produce a count and sensing at least one characteristic of the warewasher that indicates draining and refilling the reservoir. That characteristic may be the water level in the reservoir or electrical conductivity within the reservoir, for example. In response to the count having a predefined value, further operation of the warewasher is suspended until the sensing indicates that the reservoir has been drained and refilled.

DETAILED DESCRIPTION OF THE INVENTION

Figure 1:
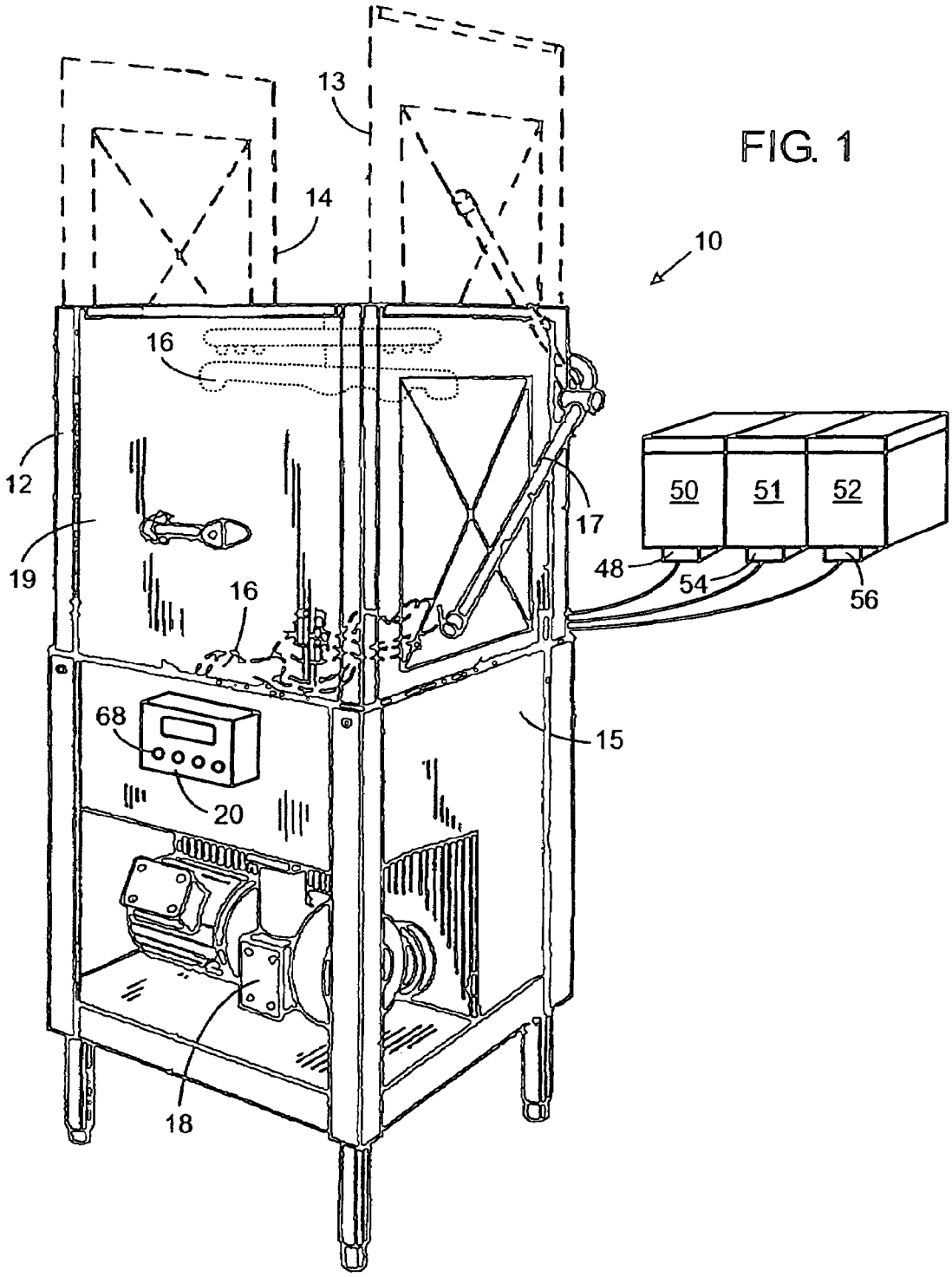
FIG. 1 is an isometric illustration of a commercial warewasher which incorporates the present invention.

With initial reference to FIG. 1, a commercial kitchen warewasher 10 has a cabinet 12 defining a chamber into which kitchenware is placed for washing. Two side doors 13 and 14 are slidably mounted on the cabinet 12 to close openings through which racks of glasses and dishes pass into and out of the chamber. The side doors 13 and 14 are connected to a link arm 17 so that they operate in unison. A front door 19 allows access to the interior of the chamber maintenance. The cabinet 12 contains standard washing and rinsing assembly that includes a plurality of nozzles 16 that spray water supplied by a wash pump 18. A region at the bottom of the cabinet 12 forms a reservoir 15 into which the water drains from the kitchenware and which holds a volume of water between washing operations. An overflow drain in the reservoir prevents the water from rising above a given level.

Figure 2:
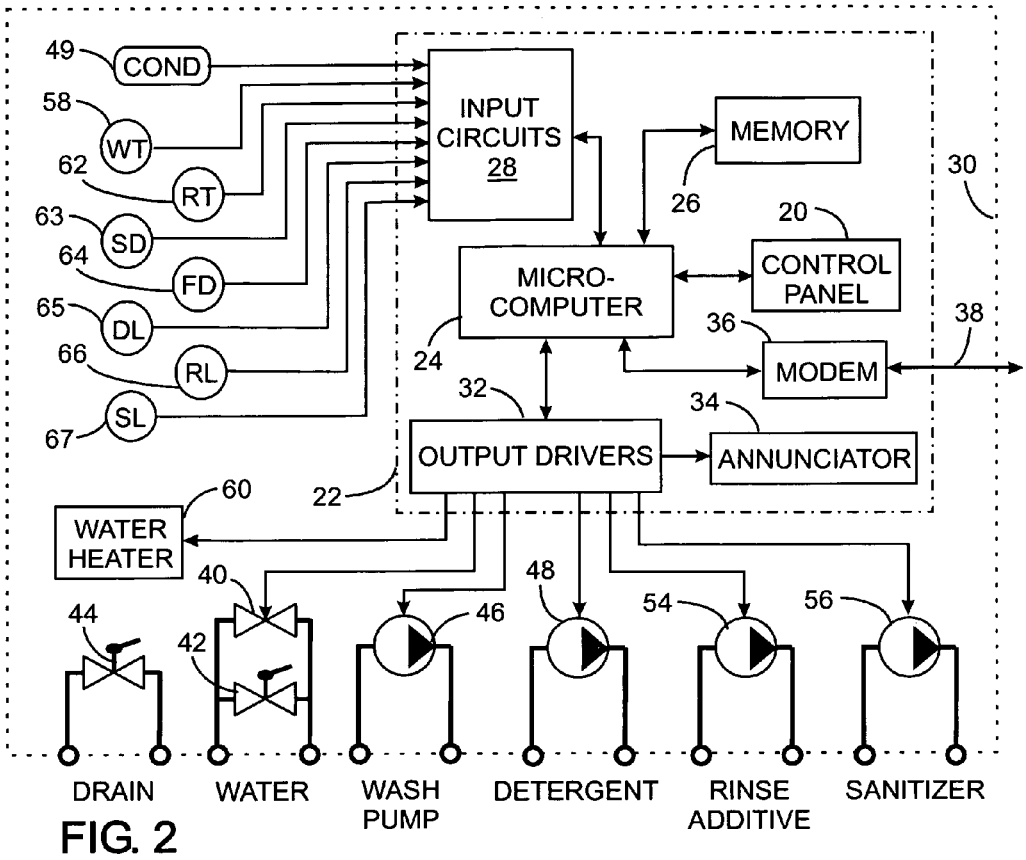
FIG. 2 is a schematic representation of control circuit for the warewasher.

Referring to FIG. 2, the warewasher 10 has a standard control system 30 that employs an electronic controller 22. The controller 22 is based on a microcomputer 24 which executes a program that is stored in memory 26 and defines the operation of the warewasher. The controller 22 includes input circuits 28 that receive signals from various devices on the warewasher 10, as will be described. Input signals also are received from the operator control panel 20 that has switches by which the human operator starts a cleaning operation and selects operational functions to be performed. The control panel 20 also has devices that provide visual indications of the functional status of the warewasher. A modem 36 is connected to the microcomputer 24 for the exchange of data with other control systems and computers via a computer network 38.

The controller 22 has several output drivers 32, one of which activates an annunciator 34, such as a buzzer or beeper to produce an audible warning or a lamp to provide a visible alert. Another output driver 32 operates a solenoid water valve 40 during the rinse cycle to send fresh water through the nozzles 16. A manually operated supply valve 42 is provided to fill the reservoir 15 at the bottom of the cabinet 12 prior to operating the warewasher 10. A drain valve 44 is manually operated to drain water from the reservoir 15 into the waste water system of the building. Another output of the controller 22 activates the wash pump 46 during the wash cycle. The controller 22 also automatically governs dispensing detergent and additives into the warewasher cabinet 12. Specifically, the microcomputer 24 determines when to activate a detergent pump 48(see FIG. 1) in response to a signal from a conductivity sensor 49, that is located below the water line of the reservoir 15. Additional containers 51 and 52 are provided to store a rinse additive and a sanitizer chemical, respectively. Other output drivers 32 operate pumps 54 and 56 to introduce the rinse additive and a sanitizer chemical into the warewasher cabinet 12 at appropriate times during the cleaning cycle.

A water temperature (WT) sensor 58 is located in the reservoir 15 to produce a signal indicating the temperature of the water. The controller 22 responds to that temperature signal by activating a water heater 60 that has a heating element within the reservoir. Another temperature sensor 62 is mounted in a conduit that carries water during the rinse cycle and thus provides an indication of the rinse water temperature (RT) to ensure that the proper water temperature is being maintained. A pair of sensor switches (SD, FD) 63 and 64 provide signals indicating when either the side doors 14 or the front door 19 is open and the controller 22 suspends operation in those cases. A set of three sensors 65, 66 and 67 respectively detect when the detergent, rinse additive and sanitizer containers 50, 51 and 52 are empty The control system 30 operates the warewasher to perform a conventional cleaning cycle which is commenced when the human operator presses the start button 68 on the control panel 20. The action also causes the microcomputer 24 to execute a software routine 70 that maintains a count of the wash cycles to monitor water quality in the warewasher 10. That routine 70 is depicted by the flowchart in FIG. 3 and begins at step 71 where the signal from the conductivity sensor 49 is read and then inspected at step 72 to determine if the conductivity is zero as occurs when the reservoir 15 is empty. For example, this condition exists when the operator has drained the reservoir in response to a previous alarm indication to do so, as will be described. When the conductivity is zero, a count of wash cycles previously stored in the memory 26 is reset to zero, at step 73 and the water quality routine 70 returns to step 71. The processing continues to loop through steps 71-73 until a non-zero conductivity measurement is received from the sensor 49 as occurs when the reservoir 15 contains water.

Then at step 74 the microcomputer 24 checks an input that indicates whether the start button 68 on the control panel 20 has been pressed by the human operator. If not, execution of the water quality routine loops back to step 71. When the operator presses the start button 68, the execution advances to step 75 at which the count of the wash cycles stored in the memory 26 is incremented. The new count is compared at step 76 to a first value that corresponds to 90% of a threshold second value X. That threshold second value is the maximum number of wash cycles that are permitted for each fill of the wash water reservoir 15. When the wash cycle count reaches 90% of that threshold, the water quality routine 70 branches to step 77 at which the microcomputer 24 activates the annunciator 34 which begins beeping to alert the human operator that it is time to change the wash water. In addition an indicator lamp on the control panel 20 also in illuminated to provide a visual alert. A message of the alarm condition also may be sent via the modem 36 to a designated device address on the computer network 38.

After the annunciator 34 has been activated, the warewasher continues to increment the wash cycle count and function normally, until at step 78 the wash cycle count is determined to have reached the threshold second value X. Upon that occurrence, the microcomputer 24 disables the normal operation of the warewasher 10 at step 79. Specifically, the controller 22 closes the rinse water valve 40, de-energizes all the pumps 46, 48, 54 and 56 and turns off the heater 60. Usually the operation will be suspended at the start of a new cleaning cycle as that is when the water quality routine 70 detects the wash cycle count threshold X being exceeded.

The microcomputer 24 then begins executing a section of the water quality routine 70 which determines when the human operator has drained and refilled the reservoir 15 with fresh water. At step 80, the signal from the conductivity sensor 49 is read and then inspected at step 82 to determine if the conductivity is zero as occurs when the reservoir 15 is empty. When that happens, the water quality routine 70 sets a drain flag at step 84 that indicates that event and then return is to step 80 to monitor the conductivity sensor 49.

The water quality routine execution continues to loop through steps 80-84 until the reservoir 15 is refilled with water at which time the conductivity rises above zero. Upon that occurrence, a determination is made at step 86 whether the drain flag is currently set as occurs when the reservoir 15 has been drained and refilled. If that is not the case the water quality routine 70 loops back to monitor the conductivity sensor 49. When the drain flag is found to be set at step 86, the water quality routine branches to step 88 at which the microcomputer 24 resets the drain flag and turns off the annunciator 34 and other devices that indicate the alarm condition. Thereafter, the water quality routine ends returning to the main washing control program at a point where a new wash cycle commences.

Figure 4:
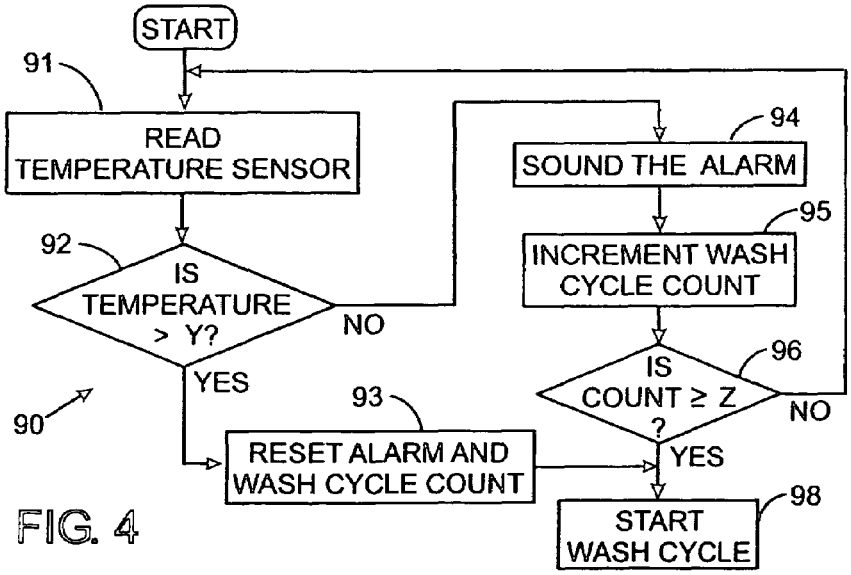
FIG. 4 is a flowchart of a software routine that suspends washing when the temperature of water within the warewasher decreases below a threshold level.

In addition to the water becoming dirty and occasionally needing to be changed, the temperature of the water within the reservoir must be monitored to ensure that it is above a level at which proper cleansing of the table and kitchen ware will occur. Normally this is not a problem as the water heater element 60 maintains the water in the reservoir at a satisfactory temperature. However, if the warewasher is operated very frequently and the temperature of the hot water added during the rinse cycles is relatively low, the water temperature in the reservoir may decrease below a desirable level. To provide a safeguard against prolonged operation of the warewasher 10 with an insufficient water temperature, the microcomputer 24 also executes a water temperature routine 90 depicted by the flow chart in FIG. 4.

This routine commences at step 91 with the microcomputer 24 reading the output signal from the water temperature sensor 58 within the reservoir 15. Then at step 92, a determination is made whether that temperature is above a threshold value designated Y at which satisfactory cleaning can occur. If the temperature is satisfactory, the program execution branches to step 93 where a temperature alarm, that might have been activated previously, is reset and a was cycle count is set to zero before advancing to step 98 to start a new wash cycle.

If the temperature is found to be an unsatisfactorily low at step 92, the control process branches to step 94 at which a low temperature alarm is activated to warn the human operator of that condition. Operation of the warewasher does not terminate at this time, but is allowed to continue for a limited number of additional wash operations. If those operations are spaced sufficiently apart in time, the reservoir water heater 60 may be able to raise the water temperature to a desirable level.

Therefore, at step 95 a wash cycle count which is separate from the similar count utilized by the water quality routine 70, is incremented with its value stored in another location of memory 26. At step 96, a determination is made whether this wash cycle count is equal to or exceeds a value at which further operation of the warewasher should be suspended until the water temperature increases to a satisfactory level. Until that number of cycles occurs during a unsatisfactory water temperature condition, the program branches to step 98 and returns to the main control program to commence a new wash cycle. If the warewasher 10 continues to operate with an unsatisfactory water temperature and the wash cycle count reaches the threshold value Z at step 96, the program execution branches back to step 91 without allowing a wash cycle to commence. Thereafter, as long as the reservoir water temperature is below the desired temperature Y, the water temperature routine 90 continues to loop without allowing a wash cycle to occur. At some time thereafter, the reservoir water heater 60 will have increased the temperature to that temperature threshold Y and the program execution will branch from step 92 through steps 93 and 98 enabling wash cycles to occur.

Just as human operators have previously ignored alarm signals to change the water in the reservoir 15, they also have ignored alarms relating to other consumables used in the washing process. As used herein, the consumables include water, detergent, rinse additives, and the sanitizer. As noted previously, sensors 65, 66 and 67 respectively detect when the containers 50, 51 and 52, which hold the detergent, rinse additive and sanitizer, become empty. When anyone of these consumables is not available for automatic dispensing into the warewasher, the microcomputer detects that based on the sensor signals. The microcomputer responds by suspending further operation of the machine until the respective container is filled with a new quantity of that consumable. At that time, the sensor signal will indicate the replenishing of that consumable and the microcomputer will once again enable operation of the warewasher.

Figure 5:
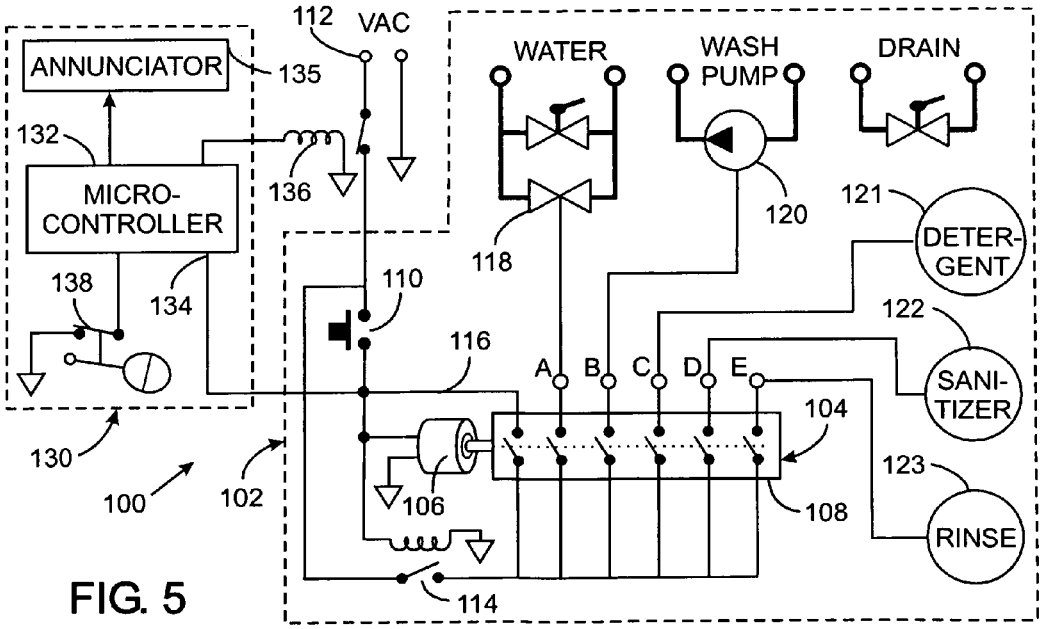
FIG. 5 is a schematic representation of an operator reminder system that is retrofitted on an existing warewasher.

Referring to FIG. 5, a version of the reminder system 130 can be retrofitted on an existing the warewasher 100 that has an electromechanical controller 102. That type of controller 102 employs a timer 104 in which an electric motor 106 drives a cam assembly 108. The cam assembly 108 includes a plurality of lobes which selectively open and close a like plurality of switches that apply power to different components within the warewasher. The speed of the motor and the shape of the cam lobes determine the sequence and periods that the components are activated during an operating cycle that includes sub-cycles for washing, sanitizing, and rinsing.

A momentary start switch 110 applies power from a power line connection 112 to the motor 106 and to the coil of a main relay 114. This causes the timer 104 to advance and close a switch that applies power from the main relay 114 to a conductor 116 thereby sustaining operation of the timer motor 106 and maintaining the main relay closed. This switch within the timer 104 opens at the end of the operating cycle, thereby stopping the warewasher until the start switch 110 is pressed again. Another switch within the timer 104 is connected via terminal A to a solenoid valve 118 which controls flow of water to the warewasher during the rinse sub-cycle. Still another switch of the cam assembly 108 is coupled via terminal B to a wash pump 120 which circulates water through spray arms and nozzles in the warewasher cabinet. The timer switches connected to terminals C, D, and E respectively control pumps 121, 122, and 123 which dispense a detergent, a rinse additive, and a sanitizer chemical at selected times during the operating cycle.

A reminder system 130 according to the present invention is added to the electromechanical controller 102 of the warewasher 100. The reminder system 130 has a microcontroller 132 in which a microcomputer, memory and input/output circuits are combined into a single integrated circuit. The microcontroller 132 has an input 134 connected to the controller conductor 116 that goes from zero volts to the line voltage when the human operator presses the start switch 110 to commence a washing cycle. Thus the microcontroller 132 counts each time that voltage makes a rising transition to keep a count of the wash cycles.

Figure 3:
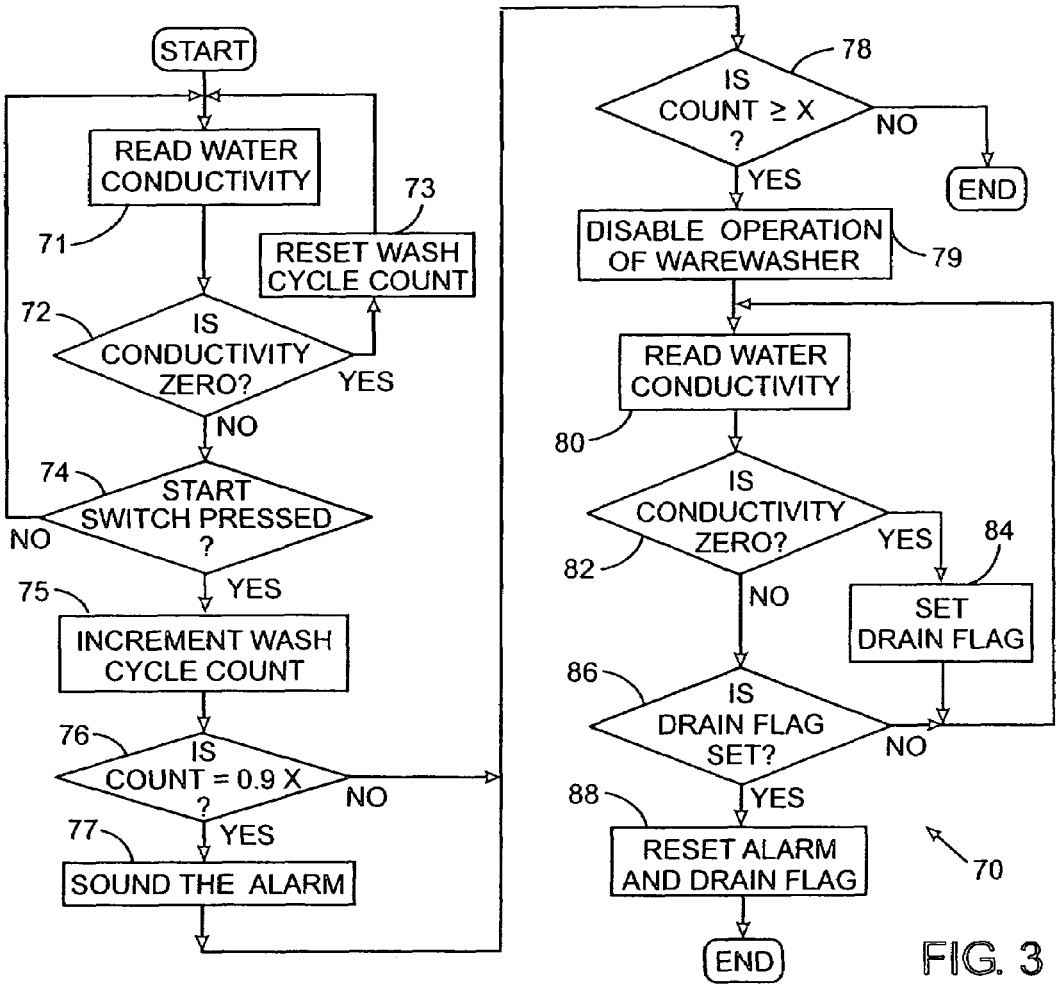
FIG. 3 is a flowchart of a software routine that is executed by the control circuit to remind the operator to change the water in the warewasher.

The microcontroller 132 executes a software program that is similar to the water quality routine 70 in FIG. 3. Therefore, when the wash cycle count reaches 90% of the threshold value, an annunciator 135 is activated to alert the human operator that it is time to change the water. If the operator continues to use the warewasher without changing the water and the count reaches the threshold value, the microcontroller 132 activates a termination relay 136 that opens a switch which disconnects the warewasher controller 102 from the electricity supply. Thus, the operation of the warewasher is suspended.

A water level sensor switch 138 is placed within the reservoir of the warewasher and is connected to an input of the microcontroller 132. That sensor switch 138 is closed when the reservoir is empty. Therefore, after the annunciator 135 is activated, the microcontroller 132 monitors the input signal from the water level sensor switch 138. That signal goes low which occurs when the water is drained from the reservoir and then goes high indicating the reservoir has been refilled. That signal sequence causes the microcontroller 132 to de-energize the termination relay 136 which reapplies electricity to the controller 102, thereby restoring operation of the warewasher.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. A method by which an electronic controller controls operation of a warewasher that has a reservoir for water, said method comprising:

electrically counting operations of the warewasher to produce a count;

sensing at least one characteristic of the warewasher that indicates draining and refilling the reservoir and in response thereto automatically producing an electrical indication; and the electronic controller responding to the count having a predefined value by disabling operation of the warewasher until the electrical indication indicates that the reservoir has been drained and refilled.

2. The method as recited in claim 1 wherein the sensing comprises sensing electrical conductivity within the reservoir.

3. The method as recited in claim 2 wherein after disabling operation of the warewasher, the operation is enabled upon the electrical conductivity having a first value and then having a second value that is greater than the first value.

4. The method as recited in claim 1 wherein sensing comprises sensing a level of a fluid within the reservoir.

5. The method as recited in claim 4 wherein after disabling operation of the warewasher, the operation is enabled upon the fluid dropping below a predefined level and then rising above the predefined level.

6. The method as recited in claim 1 further comprising activating an annunciator in response to the count, thereby alerting a human operator of a need to change the water in the reservoir.

7. The method as recited in claim 6 wherein the annunciator is activated in response to the count having a given value which is less than the predefined value.

* * * * *